US011519178B2

(12) United States Patent
Blevins et al.

(10) Patent No.: US 11,519,178 B2
(45) Date of Patent: Dec. 6, 2022

(54) WIRELESS AUTOMATIC DOWNSPOUT ACTUATION DEVICE

(71) Applicants: Michael Blevins, Mapleton, ND (US); Evan Eberle, Mapleton, ND (US); Caleb Perkinson, Mapleton, ND (US)

(72) Inventors: Michael Blevins, Mapleton, ND (US); Evan Eberle, Mapleton, ND (US); Caleb Perkinson, Mapleton, ND (US)

( * ) Notice: Subject to any disclaimer, the term of this patent is extended or adjusted under 35 U.S.C. 154(b) by 9 days.

(21) Appl. No.: 17/325,394

(22) Filed: May 20, 2021

(65) Prior Publication Data

US 2021/0372129 A1 Dec. 2, 2021

Related U.S. Application Data

(60) Provisional application No. 62/704,853, filed on May 31, 2020.

(51) Int. Cl.
*E04D 13/08* (2006.01)

(52) U.S. Cl.
CPC ..... *E04D 13/08* (2013.01); *E04D 2013/082* (2013.01); *E04D 2013/0813* (2013.01)

(58) Field of Classification Search
CPC ..... E04D 13/08; E04D 2013/0813; E04D 2013/082
USPC ..... 52/16
See application file for complete search history.

(56) References Cited

U.S. PATENT DOCUMENTS 2,567,004 A * 9/1951 Benck ..... E04D 13/08 239/521
2,975,805 A * 3/1961 Horn ..... F16L 43/00 193/17
3,060,952 A * 10/1962 Bystrom ..... E04D 13/08 137/118.01
3,316,928 A * 5/1967 Weakley ..... E04D 13/08 137/119.06
3,375,851 A * 4/1968 Schif ..... E04D 13/08 239/510
3,481,366 A * 12/1969 Mortonson ..... E04D 13/08 193/29
3,911,954 A * 10/1975 Johnson ..... F16L 27/0849 285/283
4,135,540 A * 1/1979 Felsen ..... E04D 13/08 137/875

(Continued)

FOREIGN PATENT DOCUMENTS

CN 108716446 A 10/2018

*Primary Examiner* — James M Ference
(74) *Attorney, Agent, or Firm* — Fargo Patent & Business Law, PLLC; Thomas Kading

(57) ABSTRACT

An automatic extension device for releasing a downspout extension from a raised position to a lowered position including a control board, a power source, a latch with the ability to connect to a downspout extension, and a release kickoff. The latch is controlled by the control board wherein the control board receives inputs from a data source, a moisture sensor, a calendar database, or other relevant source. The latch is connected to the downspout extension such that when the latch releases, the downspout and downspout extension become disconnected and the downspout extension can move to the lowered position. The release kickoff includes a device such as a spring to assist in initiating the downspout extension moving to the lowered position.

10 Claims, 4 Drawing Sheets

(56) References Cited

U.S. PATENT DOCUMENTS 4,270,572 A * 6/1981 Jarzynka ..... F16L 27/0845 52/16
4,470,908 A * 9/1984 Odekirk ..... B01D 35/00 210/463
5,014,745 A * 5/1991 Watt ..... F16L 27/00 52/16
5,358,007 A * 10/1994 Carlberg ..... F16L 27/08 137/561 A
5,452,743 A * 9/1995 Rortvedt ..... E04D 13/08 52/16
5,482,084 A * 1/1996 Cassidy ..... E04D 13/08 137/120
5,522,427 A * 6/1996 Johnson ..... E04D 13/08 137/616.5
5,673,519 A * 10/1997 McCaughan ..... E04D 13/08 52/16
5,735,085 A * 4/1998 Denooy ..... E04D 13/08 285/283
6,240,680 B1 * 6/2001 Estes ..... E04D 13/08 52/16
6,647,670 B1 * 11/2003 Dran ..... E04D 13/0767 52/12
6,701,675 B1 * 3/2004 Ekker ..... E04D 13/08 52/16
6,827,103 B2 * 12/2004 Cheremshynski ..... E04D 13/08 52/16
7,493,728 B2 * 2/2009 Dussault ..... E03B 3/03 52/16
8,322,083 B1 * 12/2012 Kessler ..... E04D 13/08 16/268
8,991,108 B1 * 3/2015 Zamrzla ..... B60T 7/12 239/723
10,519,669 B1 * 12/2019 Pattenaude ..... E04D 13/0685
11,136,957 B1 * 10/2021 Carone ..... E04D 13/08
2004/0035473 A1 * 2/2004 Cheremshynski ..... E04D 13/08 137/615
2006/0016129 A1 * 1/2006 Riese ..... E04D 13/08 52/16
2007/0234643 A1 * 10/2007 Siegal ..... E06B 7/32 49/169
2009/0078653 A1 * 3/2009 Koenig ..... E04D 13/064 52/12
2009/0126283 A1 * 5/2009 Lucas ..... E04D 13/08 52/16
2010/0126078 A1 * 5/2010 Leahy ..... E04D 13/0645 52/16
2011/0239547 A1 * 10/2011 Port ..... E04D 13/064 52/16
2012/0285567 A1 * 11/2012 Kessler ..... E04D 13/08 137/615
2016/0111878 A1 * 4/2016 Qureshi ..... H01R 25/006 29/622
2016/0194879 A1 * 7/2016 Gleason ..... E04D 13/0645 52/16
2017/0081857 A1 * 3/2017 Ellis ..... E04D 13/08
2017/0152662 A1 * 6/2017 Elder ..... E04D 13/08
2020/0378129 A1 * 12/2020 Gomez ..... G05D 9/02
2021/0340769 A1 * 11/2021 Ekker ..... E04D 13/08
2021/0372129 A1 * 12/2021 Blevins ..... E04D 13/08

* cited by examiner

WIRELESS AUTOMATIC DOWNSPOUT ACTUATION DEVICE

CROSS-REFERENCE TO RELATED APPLICATION(S)

This application claims the benefit of U.S. Provisional Patent Application No. 62/704,853, filed May 31, 2020, the contents of which are hereby incorporated by reference in its entirety.

FIELD OF TECHNOLOGY

This disclosure relates generally to automatic downspout technology, more particularly, to a device of utilizing a wireless automatic downspout actuation device to lower or raise a downspout connected to a gutter system.

BACKGROUND

Building gutter systems typically collect water from a roof on a building, move it, and direct it away from the building. A gutter system typically routes water to the ground through a system of gutters, downspouts, and downspout extensions. Directing water away from the building is an important function of a gutter system. Downspout extensions commonly can be raised or lowered as required. Downspout extensions should be lowered to allow rainfall to be collected and directed away from a building. Downspout extensions may be raised when one desires to mow a lawn, landscape around a house, or during select environmental seasons.

Directing water away from a building is important for several reasons. Reasons include the fact that water routed to the ground near the building may cause foundation damage, water falling from a gutter system may affect surrounding landscaping, and rainwater can be slowly deposited on the ground such not to cause divots or holes.

SUMMARY

The present application discloses an automatic extension device that automatically can lower a downspout extension from a raised position to a lowered position based on weather conditions, scheduling, or other inputs. The present application also discloses the method of releasing the downspout extension based on certain triggers.

An exemplary automatic extension device comprises a control board connected to a downspout, a power source, a latch with the ability to connect to a downspout extension, and a release kickoff. The control board in this example is capable of processing inputs to provide the desired output. The control board may receive input via a wireless system such as wireless internet, such that the downspout extension is released such that it lowers to the lowered position. The power source may include rechargeable batteries, single-use batteries, or hardwired from a building electrical system. The latch and the kickoff device may be a pin with a spring that causes the downspout extension to begin moving to the lowered position.

A control board may receive inputs from an internet source that communicate a likelihood of a certain weather event, a moisture sensor that detects a requisite level of moisture, a set of calendar data the provides a schedule, or any other relevant input.

A user may manually move the downspout extension to the raised position as desired. Alternatively, a device and method to move the downspout extension to the raised position can be employed to further automate the raising and lowering functions of a downspout extension.

BRIEF DESCRIPTION OF THE DRAWINGS

These and other features and advantages of the present invention will become more readily appreciated as the same becomes better understood by reference to the following detailed description when considered in connection with accompanying drawings, wherein.

DETAILED DESCRIPTION OF THE ILLUSTRATED EMBODIMENTS

General

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1:
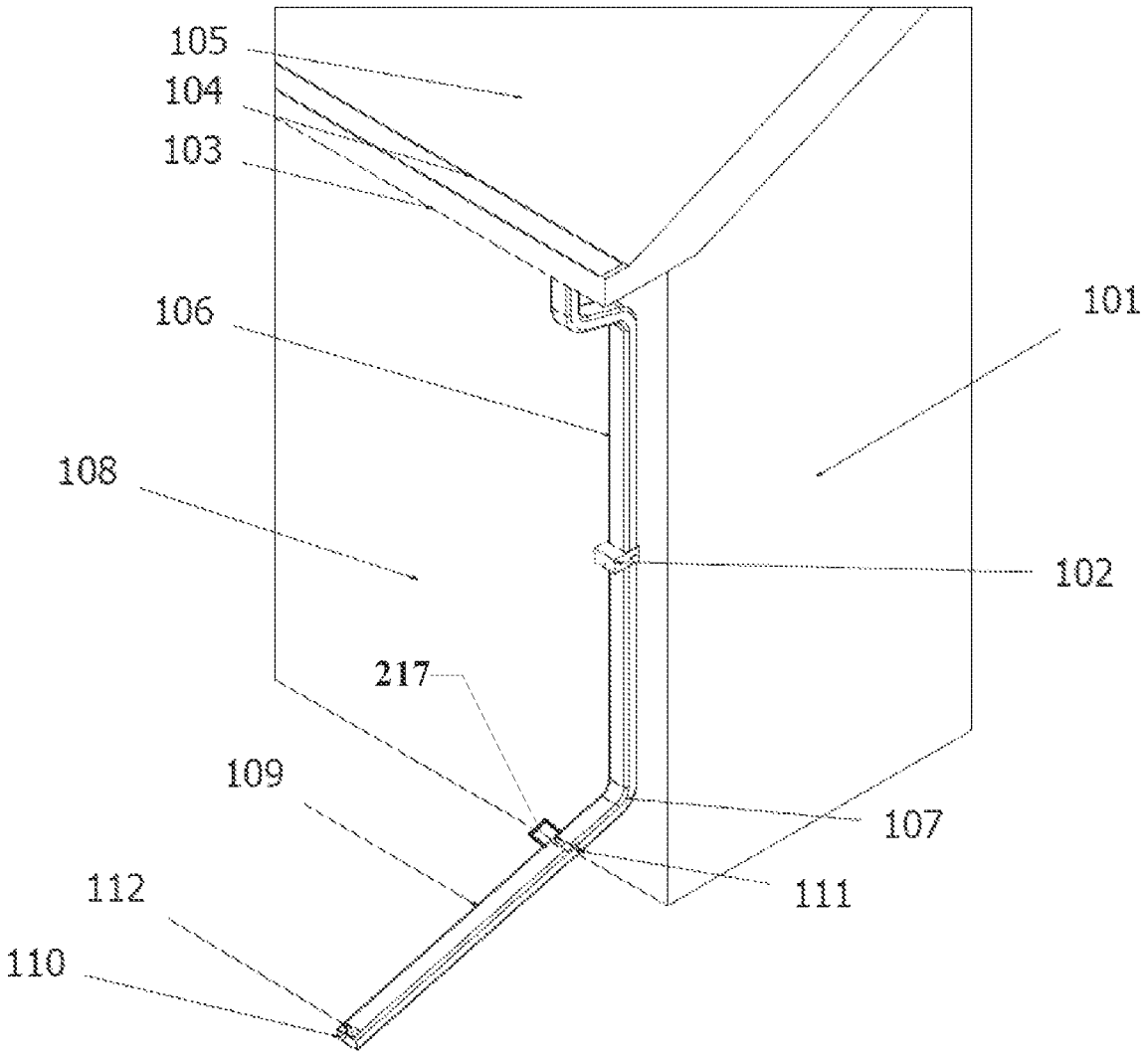
FIG. 1 shows a perspective view of a corner of a building showing a gutter system with an automatic extension device.

FIG. 1 shows a perspective view of a corner of a building structure 101 showing a gutter system with an automatic extension device 102. A gutter 103 is shown at an edge 104 of a roof 105. While the building illustrated in FIG. 1 is a residential home, it will be understood that the building structure 101 may be any type of structure, such as, for example, a garage, church, office, arena, commercial building, or any other type of building. A downspout 106 is connected to the gutter 103. The downspout 103 in this embodiment shows the downspout 106 running vertically to the ground. Near the ground the downspout 103 has an elbow 107. The elbow extends away from a wall 108 of the building structure 101. A downspout extension 109 is connected at a hinge 111.

The downspout extension 109 has a distal end 110 which is located on the opposite end of downspout extension 109 than where the downspout extension 109 is connected to the elbow 107. The downspout extension 109 is shown in FIG. 1 in a lowered position. The downspout extension 109 may be raised into a raised position. When in the raised position, the downspout extension 109 is in a position such that the alignment between the hinge 111 and the distal end 110 is vertical. Near the termination of the distal end 110 a latch catch 112 is connected. When in the raised position, the latch catch 112 is lined up with the automatic extension device 102.

Figure 2:
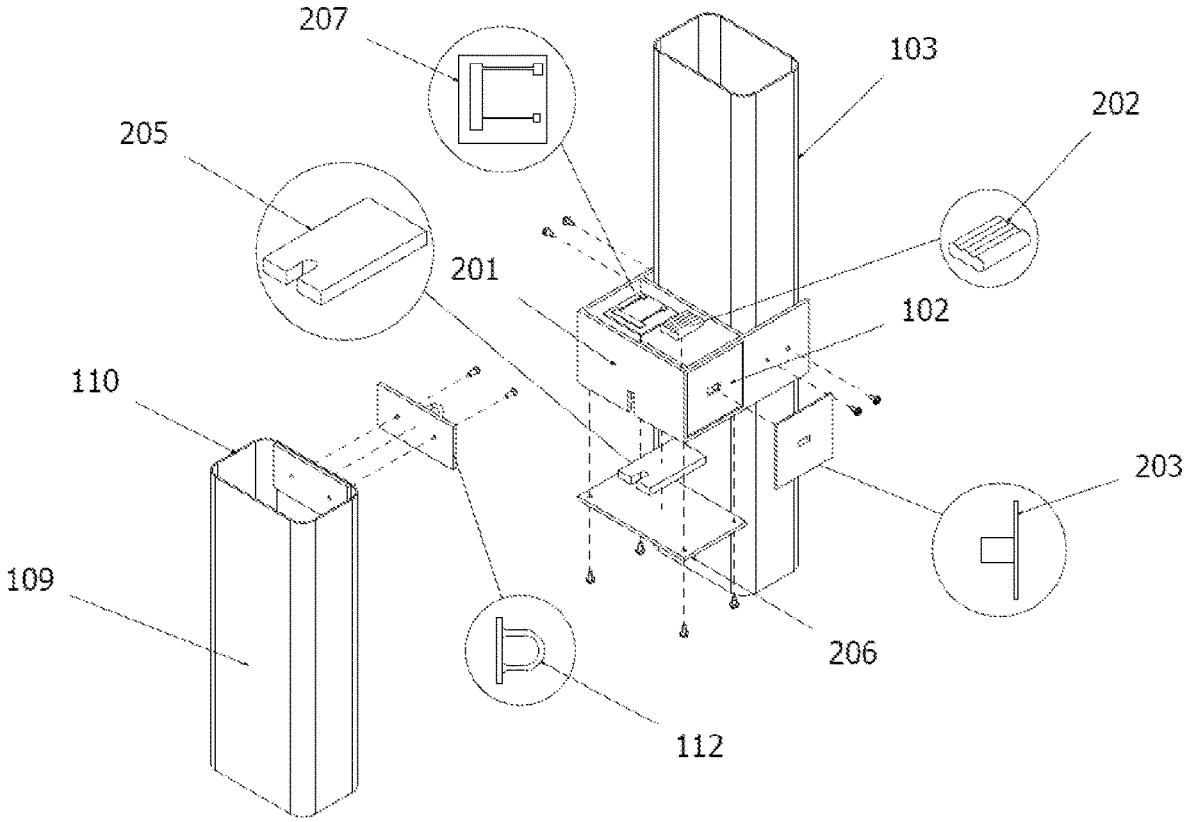
FIG. 2 shows an automatic extension device with wireless internet capabilities.

FIG. 2 is an embodiment of the automatic extension device 102 with wireless internet capabilities. The shown embodiment comprises a housing 201, a battery 202, a charging port 203, a latch catch 112, a latch 205, a device cover 206, and a control board 207. In this embodiment, the housing 201 is attached to the downspout 103. The battery is operationally connected to the control board 207. The battery 202 may be rechargeable or one-time use. Alternatively, multiple batteries may be used, a solar panel used, or the automatic extension device 102 may be electrically hardwired to the electrical system in the building structure 101. In the event the automatic extension device 102 is hardwired to the electrical system, a transformer may be used to convert from the electrical system's alternating current to the direct current used by the automatic extension device 102. The direct current or alternating current electricity supply is considered the power source. The charging port 203 is used when the automatic extension device 102 uses a battery 202. The charging port 203 may be a universal serial bus (USB) port or other electrical connector. In the event the charging port 203 is a USB, the USB port may also be connected to the control board 207 such that communication can be achieved between the control board 207 and an external device.

The latch catch 112 and the latch 205 mechanically connect together when the downspout extension 109 is in the raised position. The latch 205 can be in a closed position or an open position. The latch 205 and the latch catch 112 may be secured together when the latch catch 112 is inserted in the latch 205. The control board 207 may trigger the latch 205 to move to the open position such that the latch catch 112 can be removed from the latch 205. In practice, when the latch 205 moves to the open position when the latch catch 112 is secured to the latch 205, the latch catch 112 will begin to move away from the latch 205 due to the force from an optional kickoff spring 302 or due to the force of gravity. The latch catch 112 is connected to the downspout extension 109 near the distal end 110 of the downspout extension 109. When the latch catch 112 moves away from the latch 205, the downspout extension 109 moves away from the automatic extension device 102 into the lowered position.

The control board 207 may have any suitable configuration; as those skilled in the art appreciate, the design of the control board 207 is determined by factors such as available space and the intended function. Commonly used for the control board 207 could be a system on a chip (SoC). The control board 207 may have a transceiver, a processor, memory, or other components understood by a person with ordinary skill in the art. The control board 207 in the embodiment shown in FIG. 2 has wireless internet capabilities 211. Any communication protocol may be employed as those skilled in the art appreciate. Examples of wireless communication protocols may include Bluetooth™, WiFi™, and other such standards. The communication protocol is used to communicate with an external data source D which provides data that can trigger the latch 205 to move to the open or closed position.

The control board 207 is programed to cause the latch 205 to move to an open position based on certain conditions. The control board 207 may be programed to move the latch 205 to the open position on different days, times, or seasons. When an external data source D communicates data to the control board 207 that a moisture event may be occurring, the control board 207 may be programed to move the latch 205 to the open position. The benefit of triggering the latch 205 to move to the open position when a moisture event may occur, is that the downspout extension 109 moves to the lowered position thus allowing moisture to flow from the gutter 103 to the distal end 110 of the downspout extension 109 and away from the building structure 101.

Figure 3:
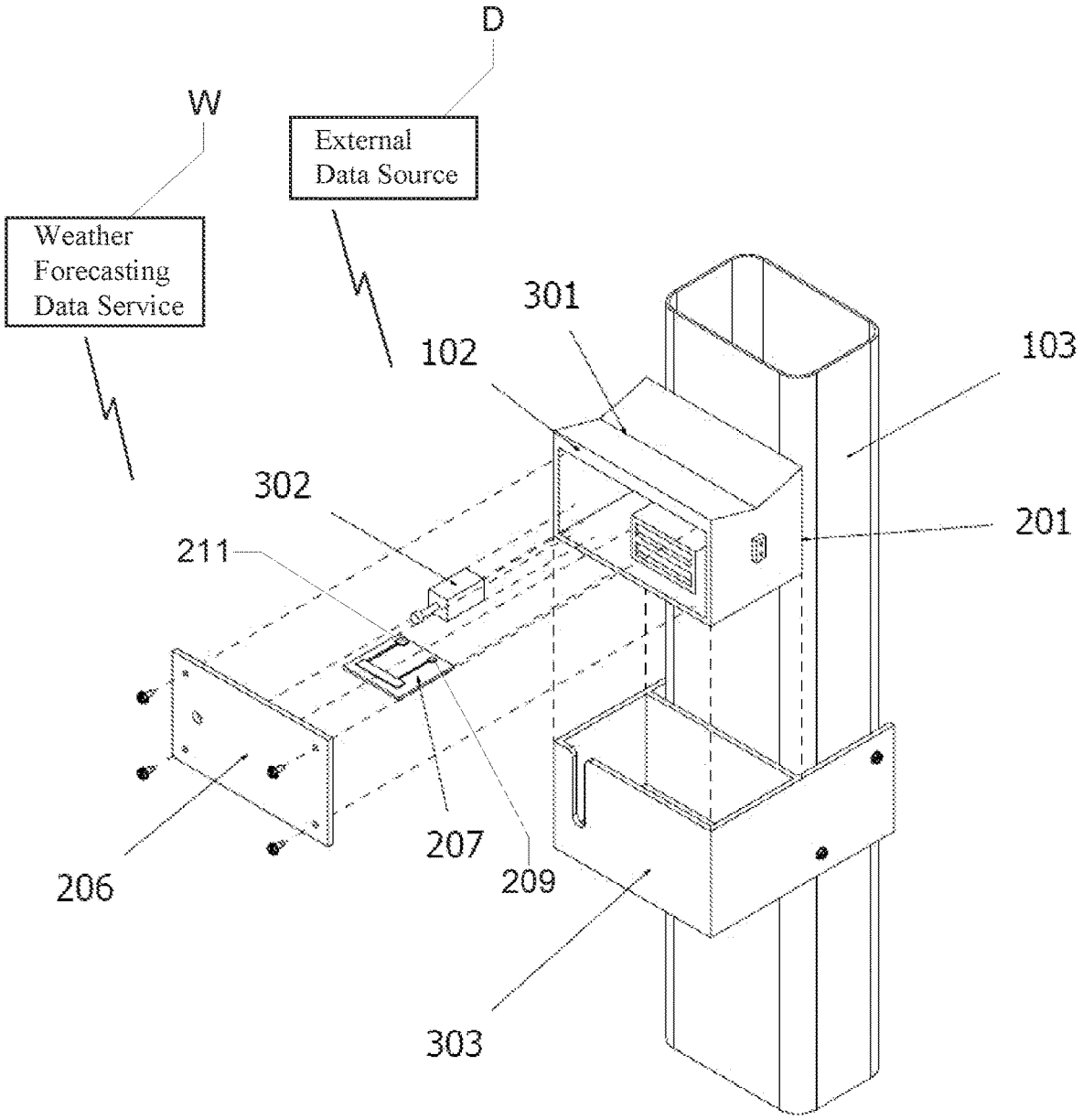
FIG. 3 shows an automatic extension device with a moisture sensor.

FIG. 3 shows an automatic extension device 102 with a moisture sensor 209. In this embodiment the top 301 of the housing 201 is inverted such that moisture may collected at the lowest point on the top 301. Moisture collected on the top 301 can be directed to accumulate in such a way to trigger a moisture sensor 209 that is electrically connected to the control board 207. The control board 207 may be programed to trigger the latch 205 to move to the open position when the moisture sensor 209 indicates moisture. Typically, the latch 205 will be constructed such that it will return to the closed position after the latch catch 112 is removed from the latch 205. A kickoff spring 302 is connected to the housing 201. When the latch 205 moves to the open position, the kickoff spring 302 applies force on the downspout extension 109 in a direction away from the downspout 103. The function of the kickoff spring 302 helps ensure that the downspout extension 109 begins falling from the force of gravity to the lowered position. When the downspout extension 109 is moved to the raised position, an amount of force is needed to cause the latch catch 112 to insert into the latch 205 and if there is a kickoff spring 302 or other similar device, the force must also be just enough to cause both the kickoff spring 302 and the latch catch 112 to reach the needed position such that the latch 205 can move to a closed position. Any type of latch may be used as appreciated by one with ordinary skill in the art.

The housing 201 has a device cover 206 which is opposite of the downspout 103. The housing 201 and the device cover 206 in this example are sized such that they will fit into a quick attach mount 303. The quick attach mount 303 allows for the housing 102 and its internal components to be removed from the downspout 103. Removing the housing 201 allows for the automatic extension device 102 to be brought to another location for service or to be taken out of the outdoor climate. It may be desired to remove the automatic extension device 102 for the winter months or other times of the year when rain or other relevant moisture events are not expected.

Figure 4:
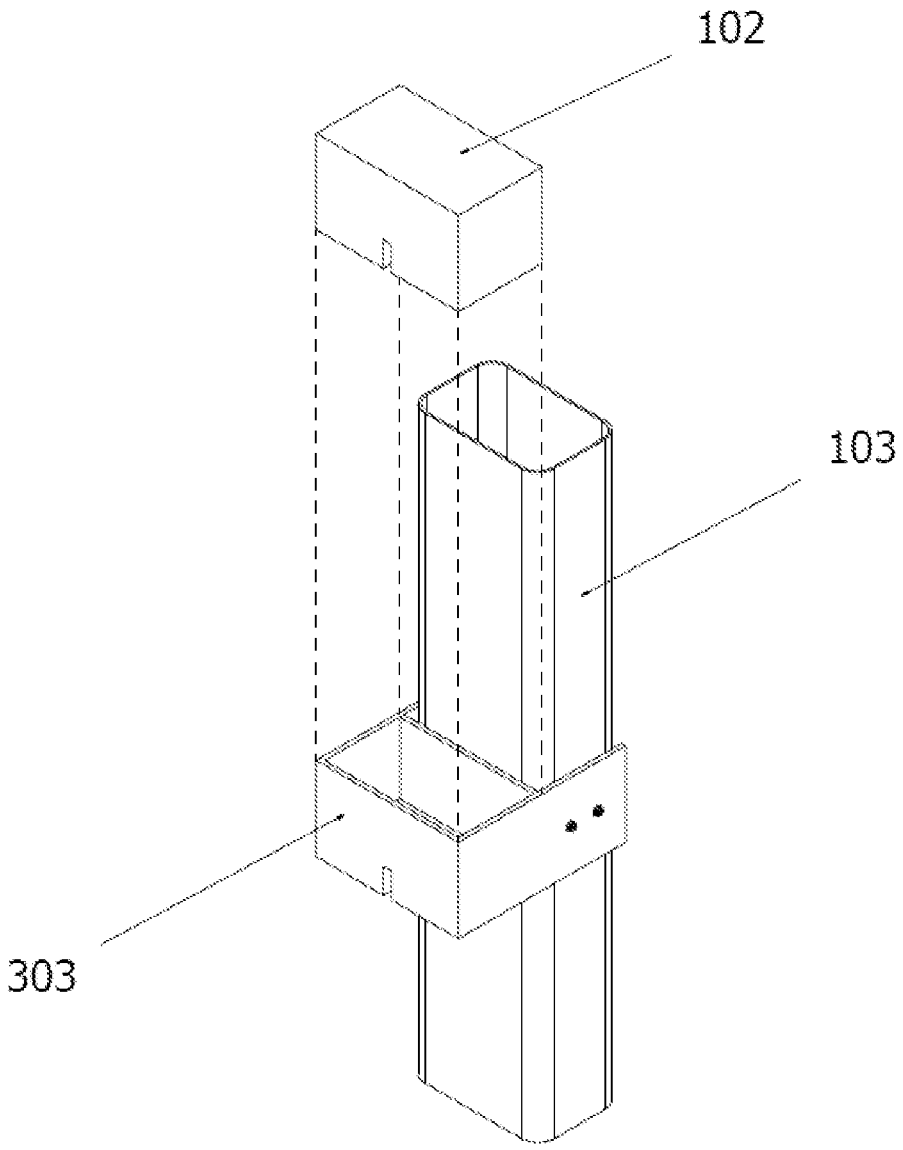
FIG. 4 shows an automatic extension device that can be removed from a downspout.

FIG. 4 is an embodiment of the automatic extension device 102 removed from a quick attach mount 303. In this example, the automatic extension device 102 is similar to the automatic extension device 102 as in FIG. 1.

In some embodiments, a spring may be installed at the hinge 111 which can be used to decrease the speed at which the downspout extension 109 moves from the raised position to the lowered position. The spring is positioned such that when the downspout extension 109 is moved to the lowered position more pressure against the downspout extension 109 is applied in an upward manner. Additionally, the spring may assist the movement of the downspout extension 109 from the lowered position to the raised position. An electric motor 217 geared to apply upward force to the downspout extension 109 may be attached to the automatic extension device 102. The electric motor 217 (FIG. 1) may be positioned next to the hinge 111 or any other location where the motive force may be transmitted to the downspout extension 109. The control board 207 may be programed to raise the downspout extension 109 to the raised position based on a time delay after moisture is detected, based on a certain time period, or other triggers.

Data sources which can be employed by the control board 207 that can trigger certain actions may include but are not limited to weather forecasting data services W, calendar databases, moisture sensors, and other sources appreciated by a person with ordinary skill in the art. Weather forecasting data service can W include radar data, news stations, and other such sources. Such data can be wirelessly transmitted to the control board 207 via a wireless technology such as WiFi™. The wireless internet capabilities 211 of the control board 207 such as WiFi™ can provide access to the internet. Weather forecasting data services W can be communicated over the internet and to the control board 207. Optionally, a smart device or computer can communicate a data command to the control board 207 over a wireless technology to cause the downspout extension 109 to be moved to the raised position or the lower position. A calendar database may include an integration to an internet calendar or any other such source.

An example of when the control board 207 uses external data to trigger the latch 205 to move to the open position causing the downspout extension 109 to move to the lowered position is when radar data indicates a rain event may occur. Weather radar data is pulled from many different sources and compiled on a variety of websites and databases on the internet. These internet web sites and databases can easily be accessed. Weather radar data can be pinpointed to a specific location on a geographic map. The geographic location of the automatic extension device 102 can be programed to the control board 207. By programing the location on the control board 207, weather radar data can communicate to the control board 207 when a rainfall event is expected to be located at the location of the automatic extension device 102. By using weather radar data, the control board 207 can trigger the latch 205 to move to the open position minutes prior to expected arrival of the rain event. If the automatic extension device 102 is equipped with a motor for the purpose of moving the downspout extension 109 to the raised position, the radar data can be used to determine when the rain event is no longer present and when the motor should be used to move the downspout extension 109 to the raised position.

Any one type of data source may be optionally used by the automatic extension device 102. Alternatively, the automatic extension device 102 may be used without an external data source D or the control board 207 may triggered by an onboard sensor.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof.

Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. An automatic extension device comprising:

a housing, the housing being attached to a downspout;

a latch, said latch being directly connected to the housing and operationally connected to a latch catch such that the latch catch may be removed from the latch when the latch moves to an open position, said latch catch is connected to a downspout extension such that the downspout may move to a lowered position when the latch catch is removed from the latch;

a control board, said control board being operationally connected to the latch and being programed to cause the latch to move to the open position to allow the downspout extension to move to the lowered position; and a power source.

2. The automatic extension device as in claim 1, wherein the power source is a battery.

3. The automatic extension device as in claim 1, wherein the power source is an electrical system in a building structure.

4. The automatic extension device as in claim 1, further comprising a charging port wherein the charging port is a universal serial bus that is operationally connected to the control board such that communication may be achieved between the control board and an external data source.

5. The automatic extension device as in claim 1, wherein the housing and components within the housing are attached to the downspout with a quick attach mount.

6. The automatic extension device as in claim 1, further comprising an electrical motor which is mechanically attached to the downspout extension wherein the electrical motor is electrically connected to the control board whereby the control board may be programed to cause the electrical motor to move the downspout extension from the lowered position to a raised position.

7. The automatic extension device as in claim 1, wherein the control board further includes a wireless internet capability such that the control board may communicate with an external data source.

8. The automatic extension device as in claim 7, wherein the external data source is from a weather forecasting service.

9. An automatic extension device comprising:

a housing attached to a downspout;

a latch connected to the housing and operationally connected to a latch catch such that the latch catch may be removed from the latch when the latch moves to an open position, said latch catch is connected to a downspout extension such that the downspout may move to a lowered position when the latch catch is removed from the latch;

a control board operationally connected to the latch and being programed to cause the latch to move to the open position to allow the downspout extension to move to the lowered position; and a kickoff spring connected to the housing wherein the kickoff spring can place a force on the downspout extension to cause the downspout extension to begin moving to the lowered position.

10. An automatic extension device comprising:

a housing attached to a downspout;

a latch connected to the housing and operationally connected to a latch catch such that the latch catch may be removed from the latch when the latch moves to an open position, said latch catch is connected to a downspout extension such that the downspout may move to a lowered position when the latch catch is removed from the latch;

a control board operationally connected to the latch and being programed to cause the latch to move to the open position to allow the downspout extension to move to the lowered position; a moisture sensor operationally attached to the control board such that if the moisture sensor indicates moisture, the control board may cause the latch to move to the open position thereby causing the downspout extension to move to the lowered position; and a top on the housing which is inverted such that moisture can be collected on the top and directed to the moisture sensor.

* * * * *